United States Patent [19]

Kessie

[11] 4,130,310

[45] Dec. 19, 1978

[54] ANTI-SEPARATION LATCHING APPARATUS

[75] Inventor: Lawrence R. Kessie, Strongsville, Ohio

[73] Assignee: Cleveland Hardware and Forging Company, Cleveland, Ohio

[21] Appl. No.: 816,512

[22] Filed: Jul. 18, 1977

Related U.S. Application Data

[63] Continuation-in-part of Ser. No. 690,410, May 27, 1976, abandoned.

[51] Int. Cl.[2] ..... E05C 1/06

[52] U.S. Cl. ..... 292/340; 292/DIG. 41; 292/171; 292/337

[58] Field of Search ..... 292/171, DIG. 41, 340, 292/337

[56] References Cited

U.S. PATENT DOCUMENTS

| | | | |
|---|---|---|---|
| 2,145,968 | 2/1939 | Bozarth | 292/171 |
| 2,200,346 | 5/1940 | Sepull | 292/171 |
| 2,497,485 | 2/1950 | Yost et al. | 292/171 X |
| 2,548,242 | 4/1951 | Rosenbarger | 292/171 |

FOREIGN PATENT DOCUMENTS

| | | | |
|---|---|---|---|
| 929958 | 6/1963 | United Kingdom | 292/DIG. 41 |
| 932346 | 7/1963 | United Kingdom | 292/DIG. 41 |

*Primary Examiner*—Richard E. Moore

[57] ABSTRACT

Latching apparatus with anti-separation feature for use with closure covers, such as vehicle doors, including interlocking back plate of bolt and striker, the back plate being mounted on the door and having a flange at the outer end which engages behind the striker mounted on door frame, when in closed and latched position, and an aperture adjacent the outer end of the bolt to accommodate an outwardly extending tang on the edge of the striker which is lockingly engaged by the bolt, with a spacer between the striker and door frame to enable such engagement of striker by back plate flange, thereby assuring three-directional containment of the striker so as to prevent undesired separation of bolt from striker because of relative movements therebetween.

6 Claims, 6 Drawing Figures

Fig. 1
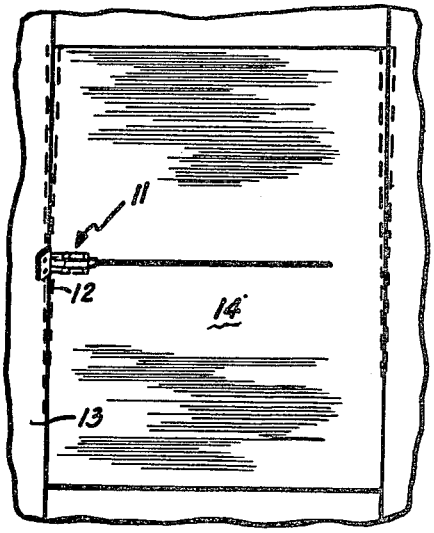
Fig. 4
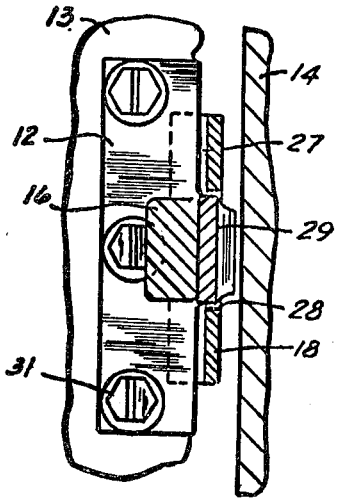
Fig. 2
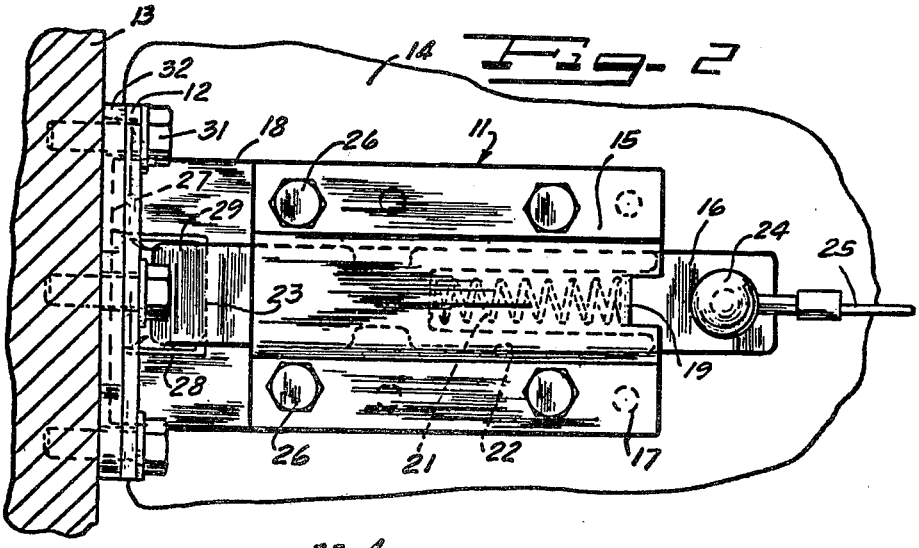
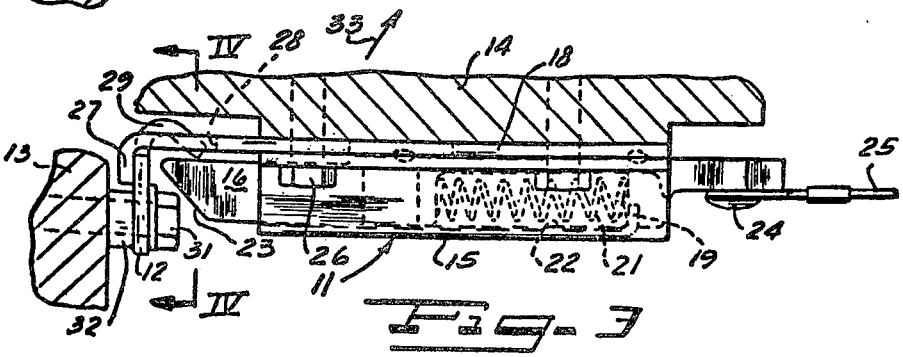
Fig. 3

ANTI-SEPARATION LATCHING APPARATUS

This is a continuation-in-part of application Ser. No. 690,410, filed May 27, 1976 now abandoned.

BACKGROUND OF THE INVENTION

1. Field of the Invention

This invention relates generally to closure latches, and more particularly to a latch for the door of a vehicle, such as a truck or trailer, that may be subjected to undesired separation of bolt and striker in any of various directions of the bolt, as may be caused by racking or other forces.

2. Description of the Prior Art

Lateral or longitudinal leaning or skewing of the sides of a truck or trailer body, for example, as caused by externally or internally applied forces, is known as "racking". When a door on the vehicle is latched by a bolt slidable on the door engaging behind or in an aperture, or the like, in a striker mounted on a door frame and is subjected to such racking or other type forces, the bolt and striker may separate and result in undesired opening of the door.

SUMMARY OF THE INVENTION

This invention eliminates such undesired opening of a closure cover, such as a vehicle door, due to movement by providing the back plate of a bolt housing mounted on a surface of the door with a flange at its outer end extending away from and normal to the door surface, and an aperture adjacent the outer end of the bolt to accommodate a flange portion or tang provided on the edge of a striker which is mounted on the door frame is spaced relationship thereto to enable engagement of the striker by the back plate end flange when the door is swung shut and prevent relative movement of back plate and striker that otherwise could result in undesired separation of the bolt from latching engagement with the striker. It will be understood that swinging the door shut causes longitudinal movement of the bolt against its customary spring by engagement of the outer end of the bolt with the flange portion or tang of the striker, and as the door reaches closed position, the spring extends the bolt into latching engagement with the striker flange portion.

In the drawings:

FIG. 1 is an elevational view of a vehicle door with a latch embodying the features of this invention mounted thereon;

FIG. 2 is an elevational view similar to FIG. 1, on a larger scale, and showing a portion of the door frame in vertical section;

FIG. 3 is a top plan view of the latch mechanism of FIG. 2 with portions of the door and door frame shown in horizontal section;

FIG. 4 is a vertical sectional view taken substantially on the line IV—IV of FIG. 3;

DESCRIPTION OF THE PREFERRED EMBODIMENT

Figure 5:
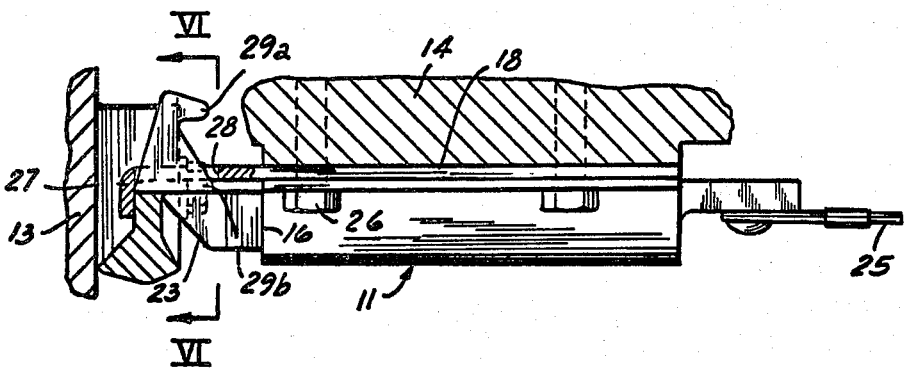
FIG. 5 is a top plan view, with portions of the door, frame and striker in horizontal section, similar to FIG. 3 of a latch mechanism having a modified form of striker with multiple latching projections.

Referring more particularly to FIG. 1, a latch mechanism embodying the features of this invention is disclosed as comprising a bolt portion, indicated generally by reference numeral 11, and a striker 12, the latter being mounted on a door frame 13 and the bolt portion 11 shown as mounted on the inner surface of a door 14. In this illustrated installation, FIG. 1 is a view rearwardly from the interior of a truck or trailer, with the door 14 being in its rear end wall. It will be understood, however, that the instant latch mechanism is intended for use in connection with any door in any vehicle, the mounting thereof herein illustrated being an example of one such use. An alternate mounting arrangement (not shown) is where the latch mechanism is mounted on an associated handle structure itself mounted on the door. Additionally, it will be understood that the herein disclosed invention can be utilized for the anti-separation latching of other type closures and associated covers, such as for windows and window frames and cabinets, for example.

The "racking" previously referred to may be in the form of lateral leaning or swaying of the sides of the vehicle, as illustrated by the broken lines in FIG. 1.

In FIGS. 2 and 3, the bolt portion 11 is shown as comprising the usual bolt housing 15 having a central portion slidably housing a bolt 16 and longitudinal edge flanges suitably secured, as by spot welding at 17, for example, to a novel back plate 18. A tang 19 is struck toward the bolt 16 from the inner end of the central portion of bolt housing 15 to anchor or engage the inner end of a spring 21 which is disposed within a cavity 22 formed in the bolt 16 to urge the bolt longitudinally outwardly to a latching position. The outer end of the bolt 16 preferably is provided with a cam surface 23 (FIG. 3) for a purpose later to be described, and its inner end is attached, as by means of a screw 24, to a cable 25 or any other desired means for retracting the bolt 16 in the housing 15 against the action of the spring 21.

The longitudinal flanges on the bolt housing 15 and the back plate 18 are provided with suitable apertures for receiving bolts 26, or the like, for mounting or securing the bolt portion 11 on the door 14. The outer end of the back plate 18 terminates in an end flange 27 (FIGS. 3 and 4) normal or extending at a right angle thereto toward the bolt, and the back plate 18 has an aperture 28 adjacent the outer end of the bolt 16.

Figure 6:
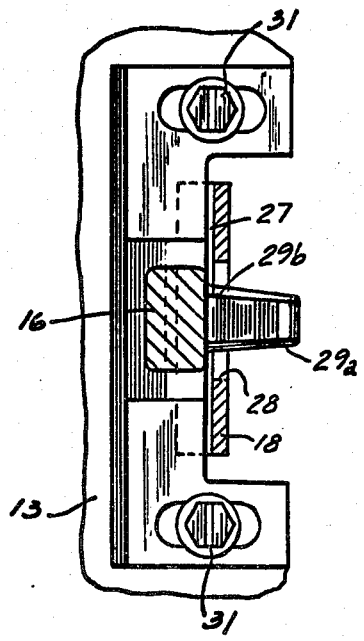
FIG. 6 is a vertical section taken substantially on the line VI—VI of FIG. 5.

The striker 12 is provided on its outer or active edge with an outwardly extending tang or flange portion 29 (best seen in FIG. 3) for engagement with and to provide a single latching position for the outer end of the bolt 16. The tang 29 is so dimensioned as to be received by and extend through the aperture 28 in the back plate 18. Bolts 31, or the like, secure the striker 12 to the door frame 13. In order to enable engagement of the end flange 27 of the back plate 18 back of or with the inner side of the striker 12, a spacer plate 32 is interposed between the latter and the door post 13. Depending upon the desired latching operation, those skilled in the art can readily appreciate that the striker 12 can be modified to comprise a tang having multiple latching projections 29*a* and 29*b* (FIGS. 5 and 6) respectively engageable in serial fashion with the end of bolt 16 so as to provide various intermediate and full latching positions once the door 14 has been swung shut.

It will be understood that the door 14 of the structure herein illustrated is hinged or otherwise suitably mounted for opening (transverse) movement in the direction of arrow 33 in FIG. 3, and it will be appreciated that the latch mechanism herein disclosed may be employed as desired with any door of any vehicle and that the bolt portion 11 can be mounted on a door frame or post, with the striker 12 on the door, if such arrangement is appropriate. Additionally, it will be understood that the latch mechanism herein disclosed can be either a single installation, or of the type wherein several such mechanisms operate in tandem.

In closing the door 14, the door is moved relative to the door frame 13 in a direction opposite the arrow 33 in FIG. 3, the cam surface 23 of bolt 16 first striking against the tang 29 of the striker 12 to move the bolt longitudinally inward against spring 21, and the bolt then being moved outwardly by spring 21, after it has cleared the tang 29, to engage behind the inner edge of the striker tang. Outward transverse movement or opening of the door then is prevented by such engagement of the outer end of bolt 16 and striker tang 29. At the same time, the end flange 27, by virtue of the back plate aperture 28 receiving the tang 29, moves behind the striker 12 so as to engage the same and thereby prevent longitudinal separation of the bolt portion 11 from striker 12, as might result from racking. The fact that the back plate aperture receives and harbors the tang 29 when latching has been effected prevents lateral separation of the bolt portion 11 from the striker 12, as might also result from racking. Accordingly, the striker 12 is provided with three-dimensional containment by the bolt portion 11 and separation of the same so as to permit opening of the door can be effected only by intentional longitudinal movement of bolt 16 against spring 21 to a position to clear the outer end of the bolt inwardly from the striker tang 29.

It is thought that the invention and many of its attendant advantages will be understood from the foregoing description, and it will be apparent that various changes may be made in the form, construction, and arrangement of the parts without departing from the spirit of the invention or sacrificing all of its material advantages, the form hereinbefore described and shown in the drawings being merely a preferred embodiment thereof.

The embodiments of the invention in which an exclusive property or privilege is claimed are defined as follows:

1. An anti-separation latch for a closure having a frame and a cover mounted for movement relative thereto between open and closed positions, comprising a striker mounted on said frame, and latch mechanism including a back plate mounted on said cover having a substantially right-angled and forwardly extending end flange engageable with the inner side of said striker when said cover is in closed position, a bolt longitudinally spaced from said end flange and slidable on said back plate, and spring means urging said bolt to extended position, the outer end of said bolt contacting said striker as said cover is moved toward closed position to retract said bolt against the action of said spring means, and said spring means moving said bolt into latching engagement with said striker when said cover is in closed position for preventing transverse opening movements thereof, whereby the engagement of said end flange and said inner side of said striker prevents relative longitudinal movement between said latch mechanism and said striker.

2. An anti-separation latch, according to claim 1, and including spacer means interposed between said striker and said frame to provide clearance for said end flange of said back plate as said cover is moved to closed position.

3. An anti-separation latch according to claim 2, wherein said striker is provided with an outwardly extending tang engageable with the outer end of said bolt when said cover is in closed position.

4. An anti-separation latch according to claim 3, wherein said back plate is provided with an aperture adjacent the outer end of said bolt for receiving and cooperatively interlocking with said tang on said striker, whereby relative lateral movement between said latch mechanism and said striker is prevented.

5. An anti-separation latch according to claim 4, wherein said tang is in the form of an outwardly extending flange, and the outer end of said bolt is provided with a cam surface engageable with said outwardly extending flange as said cover is moved to closed position.

6. An anti-separation latch according to claim 5, wherein said tang is provided with a plurality of latching projections operable to respectively latchingly engage said bolt for effecting various intermediate and full latching positions of said cover.

* * * * *